US006006922A

United States Patent [19]

Bielagus

[11] Patent Number: 6,006,922

[45] Date of Patent: Dec. 28, 1999

[54] SPACER FOR BAR SCREEN

[75] Inventor: Joseph B. Bielagus, Tualatin, Oreg.

[73] Assignee: Beloit Technologies, Inc., Wilmington, Del.

[21] Appl. No.: 08/982,835

[22] Filed: Dec. 2, 1997

[51] Int. Cl.[6] ..... B07B 1/49; B07B 13/05

[52] U.S. Cl. ..... 209/396; 209/393; 209/674; 209/679; 209/392

[58] Field of Search ..... 209/392, 393, 209/396, 674, 679

[56] References Cited

U.S. PATENT DOCUMENTS

| | | | |
|---|---|---|---|
| 1,982,244 | 11/1934 | Davis | 209/393 |
| 5,245,904 | 9/1993 | Meyerle | 83/529 |
| 5,257,699 | 11/1993 | Fricker et al. | 209/672 |
| 5,476,179 | 12/1995 | Jones et al. | 209/396 |
| 5,868,259 | 2/1999 | Bielagus | 209/674 |

*Primary Examiner*—Donald P. Walsh
*Assistant Examiner*—Daniel Keith Schlak

[57] ABSTRACT

A doughnut or puck-shaped spacer has a centrally positioned square hole. A pie-shaped cutaway portion of the spacer allows the spacer to be elastically deformed mounting on a square rod. The rod and spacers join together the bars of a bar screen rack. Bars making up a screen bed are approximately one-quarter inch thick and cantilevered sections of the screening bars benefit from being joined together to control the spacing of the bars and to add rigidity to each rack of bars which makes up the bar screen rack. For ease of assembly, canted slots receive a square rod. The spacers are readily positioned between legs on the square rod. The individual bars are then joined by tightening a nut at the threaded end of the rod, clamping the bars in spaced parallel relation.

5 Claims, 2 Drawing Sheets

SPACER FOR BAR SCREEN

FIELD OF THE INVENTION

The present invention relates to apparatus for screening particulate matter such as wood chips and municipal trash in general and relates to bar screen apparatus in particular.

BACKGROUND OF THE INVENTION

Bar screens have proven particularly valuable in sorting materials which have unequal dimensions. Wire or punched screens are typically used to sort materials of a granular nature in which all three dimensions are approximately equal. However, many classes of objects, including two of particular commercial interest, wood chips and municipal or industrial trash, are not readily amenable to separation by conventional screening processes.

In the manufacture of paper, logs are reduced to wood chips by chipping mechanisms, and the chips are cooked with chemicals at elevated pressures and temperatures to remove lignin. The chipping mechanisms produce chips which vary considerably in size and shape. For the cooking process, which is known as digesting, it is desirable that the chips supplied have a uniform thickness in order to achieve optimal yield and quality. Ideally, the supplied chips will allow production of a pulp which contains a low percentage of undigested and/or overtreated fibers. Thus, a means is needed to separate chips on the basis of thickness rather than any other dimension. Bar screens have proven particularly adept at separating materials based on a single dimension such as thickness.

With the rise in the recycling culture, a strong demand for an apparatus for separating municipal and industrial trash into its constituent components for recycling has developed. Conventional separation systems which utilize rotating screen drums have proved ineffective. Municipal trash, which typically contains a certain portion of stranded material as well as sheet-like materials, tends to clog the screens. Further, the tumbling action of screens can result in the breakage of components of the municipal waste stream such as glass bottles thereby increasing the difficulty of recycling them.

Bar screens consist of two sets of generally rectangular bars which are joined together. Each set of bars is thus connected into an array or rack. The two sets of bars are interleaved to form a screening bed. The bed consists of the elongated, rectangular bars and the narrow, rectangular spaces between the bars. Material to be sorted is introduced to the surface of the bed and the bars are caused to oscillate so that when one set of bars is going up, the other set is going down.

This oscillatory motion tends to tip wood chips or other relatively small planar objects on edge so that those of a given thickness may slide through the gaps between the bars. Alternatively, it has been found when separating office waste paper, that bar screens prove effective in removing extraneous litter from the recovered office paper.

Recent developments in bar screens have led to using bars of narrower widths. Narrower bars allow greater open area between bars which in turn allows greater screening area for a bar screen of a given size. The thinner bars require bar attachment systems and bar structures which are adapted to provide greater support for the thinner and hence less stiff screening bars. To provide greater stiffness in the rack of thinner bars each bar has, in addition to the two legs which mount the bar to the bar screen, a cantilevered leg which does not attach to any structure. Each cantilevered leg is joined to adjacent legs on adjacent bars by a rod which passes through the cantilevered legs. Spacers constructed of resilient material are placed between the cantilevered legs. The process of assembling the rod, legs, and spacers can be labor intensive.

What is needed is a spacer for positioning between cantilevered legs which facilitates assembly of the screen bars into a rack.

SUMMARY OF THE INVENTION

The spacer for joining the cantilevered legs of individual bars in a bar screen of this invention has a doughnut or puck-shaped spacer with a centrally positioned square hole. A pie shaped cut-away portion of the puck allows the spacer to be elastically deformed to allow the spacer to be mounted on a square rod. The rod and spacers join together the bars of a bar screen rack. Two interdigitating racks form the bar screen.

The bars comprising each screen bed have spaced apart depending legs, each of which is clamped into a fixture which mounts the legs to one of two bar support beams which interconnect to drive frames. In order to maximize the open area of the screen bed, the bars are approximately one-quarter inch thick and thus the legs, which are of equal thickness, are clamped and locked to the drive frames.

Each bar of each rack of bars has two depending legs which are mounted to the oscillating drive frame. The bar proper extends between the support legs and typically extends beyond the support legs to a section of bar which is cantilevered to one side or the other of the portion of the bar between the support legs. The cantilevered sections of the support bars benefit from being joined together to control the spacing of the bars and to add rigidity to each rack of bars which makes up the bar screen deck. The cantilevered portions of the bars have short depending legs.

A long rod which is threaded on at least one end is then passed through each of the cantilever legs of the rack of bars and through polyurethane spacers which are positioned between the cantilever legs. The threaded rod engages a bolt at each end of the screen rack which may be tightened to clamp and compress the bars in parallel spaced relation.

For ease of assembly, the through thickness holes in the cantilever legs of the bar screen may be canted slots which receive a square rod. The spacers are readily positioned between legs on the square rod. The individual bars are then joined by tightening a nut at the threaded end of the rod to clamp the bars in spaced parallel relation.

It is a feature of the present invention to provide a spacer for a bar screen which facilitates assembly of the bar screen.

It is another feature of the present invention to provide a spacer for a bar screen which facilitates repair and replacement of individual spacers.

It is a further feature of the present invention to provide spacers which can readily be replaced to vary the durometer of the spacers depending on use experience.

Further objects, features, and advantages of the invention will be apparent from the following detailed description when taken in conjunction with the accompanying drawings.

DESCRIPTION OF THE PREFERRED EMBODIMENTS

Figure 1:
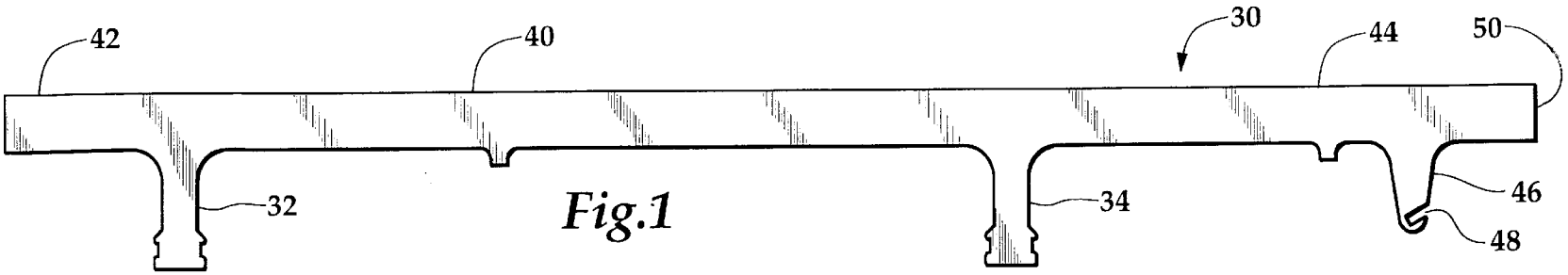
FIG. 1 is a side elevational view of the screen bar employed with the bar spacers of this invention.
Figure 5:
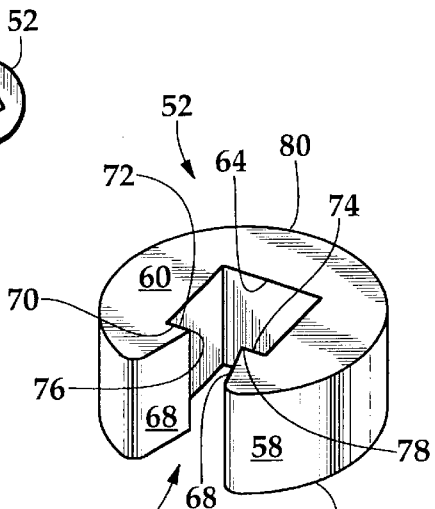
FIG. 5 is an isometric view of the bar screen spacer of this invention.
Figure 6:
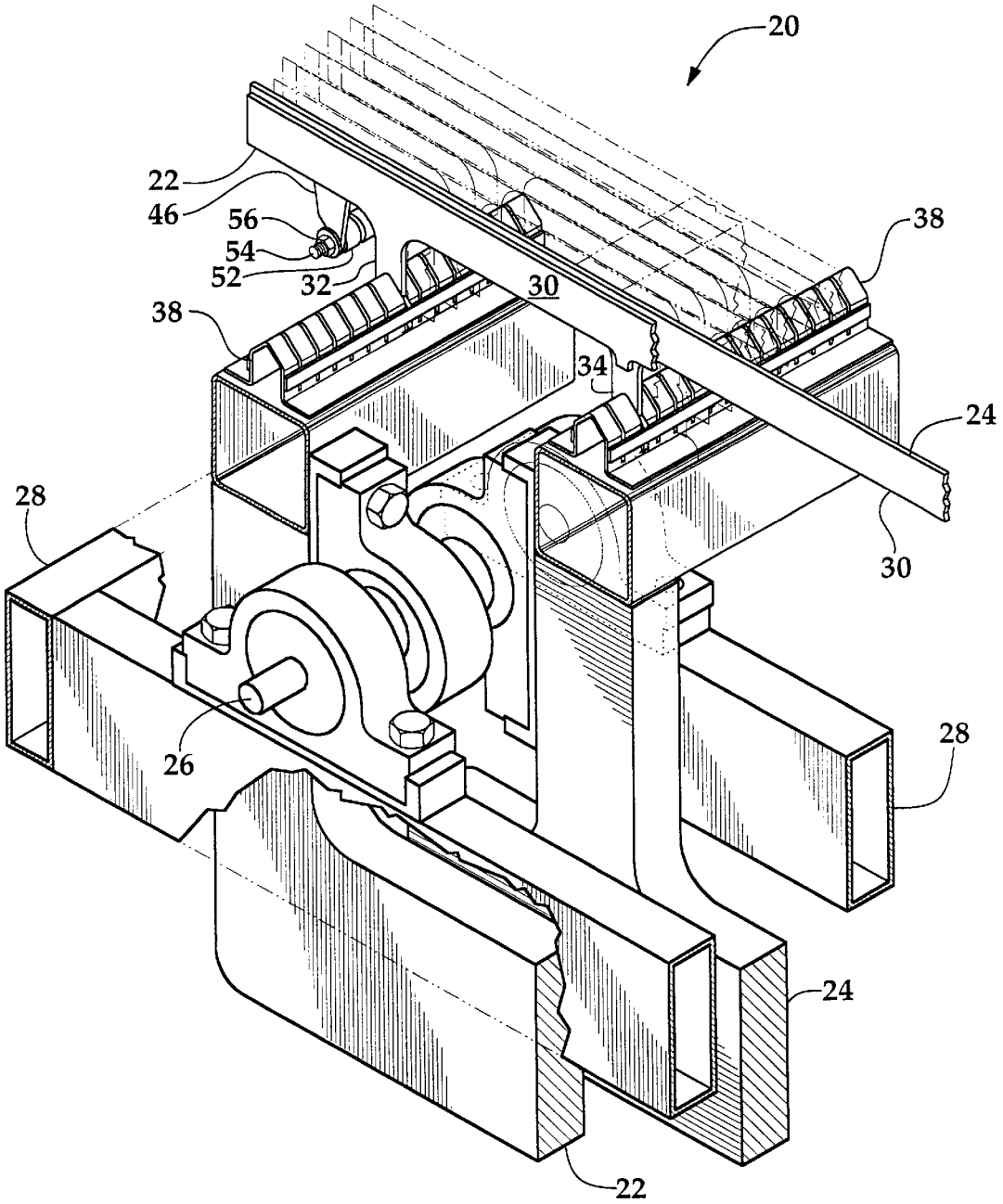
FIG. 6 is a fragmentary cutaway isometric view of a bar screen employing the spacers of invention.

Referring more particularly to FIGS. 1–6, wherein like numbers refer to similar parts, a cut-away segment of a bar screen 20 is shown in FIG. 6. The bar screen 20 has two frames 22, 24 which are mounted to an eccentric shaft 26. The shaft 26 is mounted to a machine frame 28 and a motor (not shown) causes the shaft to rotate. The rotating shaft causes the two frames 22, 24 to oscillate in the vertical and horizontal direction, but each frame oscillating 180 degrees out of phase from the other. The bar screen 20 is described in detail in my co-pending application entitled Bar Screen Drive System Ser. No. 08/773,392 filed Dec. 26, 1996, which is incorporated herein by reference. The bar screen 20 employs screen bars 30 such as shown in FIG. 1. The bars 30 are arranged in two racks which interdigitate with each other. A rack of bars 30 is mounted to each of the frames 22, 24 and the oscillatory motion of the frames causes the bars to move relative to each other to produce the screening action.

The bars are constructed of relatively thin gage steel. Conventional bar screens typically have screening bars of half an inch or greater in thickness, but the bar screen 20 permits the construction of practical devices with screening bars having widths of only a quarter of an inch or less.

For a given bar screen deck area, the use of thinner bars allows more bars to be used and consequently there are more screening gaps between bars. It is the spaces between bars which equate to the open area of a screen frame which in general govern the rate at which material can be sorted by a given bar screen. Thus a bar screen that employs thinner bars has greater productivity.

The bars 30 have a first leg 32 and a second leg 34 which are rigidly attached by brackets 38 to one of the two oscillating frames. Each bar 30 has a portion of the bar 40 which extends between the two leg 32, 34 and has two cantilevered sections: a short cantilevered section 42 and a long cantilevered section 44. The long cantilevered section 44 has a short depending leg 46. The depending legs 46 have an upwardly opening slot 48 which faces the end 50 of the bar 30 adjacent to the depending leg 46. The bars 30 are spaced apart so that interdigitating bars and screening spaces between bars may be accommodated between adjacent bars 30 in a screening rack.

Figure 4A:
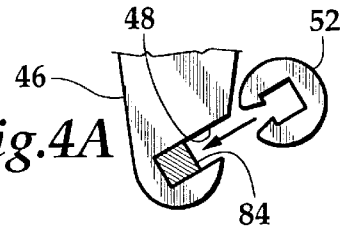
FIG. 4A is an illustrative view showing how a spacer is inserted between screen bars where the spacer is not yet inserted.
Figure 4B:
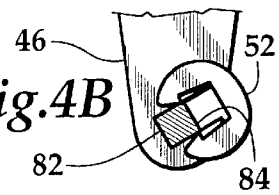
FIG. 4B is an illustrative view showing how a spacer is inserted between screen bars where the spacer is partially inserted.
Figure 4C:
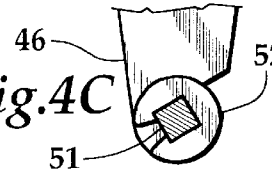
FIG. 4C is an illustrative view showing how the spacer is inserted between screen bars where the spacer is fully inserted.
Figure 3:
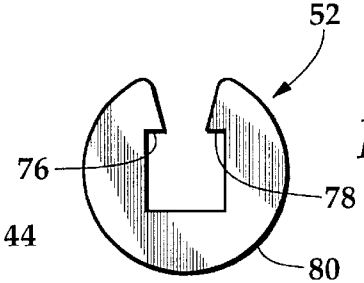
FIG. 3 is a plan view of the bar spacer of this invention.
Figure 2:
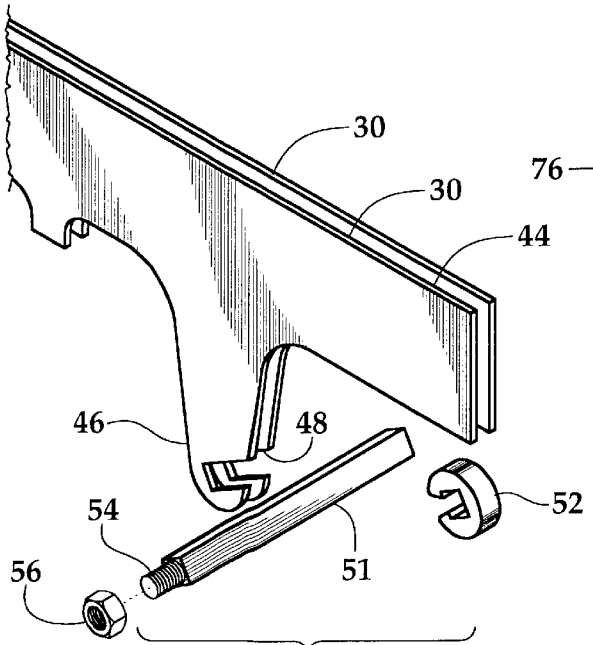
FIG. 2 is a fragmentary exploded isometric view of a system of screen bars and a bar spacer showing how the bar spacer is assembled between screen bars.

The long cantilevered sections are stabilized by joining the short cantilevered legs together with a square rod 51 that fits into the upwardly opening slots 48. As shown in FIGS. 4A through 4C, spacers 52 are mounted on the rod 51 and positioned between adjacent depending legs 46. As shown in FIG. 2, the rod 51 has a threaded end 54, and a nut 56 which engages the threaded end 54 which allows all the legs 46 and spacers 52 to be clamped together.

Each spacer 52, as best shown in FIG. 5, has an overall cylindrical shape like a hockey puck. The spacer 52 has an outer cylindrical wall 58 and an first planer surface 60 which is spaced from and generally parallel to a second planar surface 62. A square hole 64 is formed in the center of the body of the spacer 52. The square hole 64 accommodates the rod 51. The spacer is formed of relatively soft rubber with a durometer of 90 A. An inlet opening 66 extends between the outer cylindrical surface 58 of the spacer and the square hole 64. The inlet opening,, as shown in FIG. 4B, allows the spacer 52 to be inserted between depending legs 46 onto the rod 51 The opening 66 is defined between two tapered sides 68 which extend from the outer surface 58 to a side 70 of the square hole 64.

Retaining portions 72, 74 of spacer which extend from the side 70 form barbs 76, 78 which are opened by resilient deflection of the body 80 of the spacer 52. The tapered sides 68 when pushed against the rod 51 cause the barbs 76, 78 to open allowing the rod 51 to pass through the opening 66 as shown in FIG. 4B. The resilient body 80 causes the opening 66 to close when the barbs 76, 78 pass over the rod 51 as shown in FIG. 4C.

The flat retaining portions 72, 74 engage against the flat side 82 of the rod 51 locking the spacer 52 onto the rod 51. Although the spacer 52 could be inserted by pressing against any side of the square rod 51, it is preferably inserted by pushing against the side 84 of the square rod 51 facing out of the slot 48, as the pressure on the spacer 52 will then have no tendency to displace the rod 51 from the slot 48.

It should be understood that the spacers 52 may be constructed of rubber having a greater hardness, for example a durometer of 90 D. Furthermore, other resilient or plastics materials could be used to form the spacers. In addition, the rod 51 used to connect the bars 30 could be round, hexagonal, triangular or similar shape, with the spacers having corresponding geometries. In addition, the slots 48 in the bar short depending bar legs could be holes with the rod passing through successive holes.

It should also be understood that the spacers can be used with any bar screen to stabilize a cantilevered section of a multiplicity of screening bars which move together.

It is understood that the invention is not limited to the particular construction and arrangement of parts herein illustrated and described, but embraces such modified forms thereof as come within the scope of the following claims.

I claim:

1. A rack of screen bars for use in a bar screen, the rack comprising:

a plurality of screen bars arrayed in spaced parallel relation, each bar having at least two depending legs for mounting the bars to a bar screen apparatus, wherein a centrally supported section of each bar is defined between the two legs, and a cantilevered portion extends from the centrally supported portion, wherein the cantilevered portion has a depending cantilevered leg, the cantilevered leg having rod receiving portions;

a rod extending through the rod receiving portions of the cantilevered legs of said plurality of screen bars;

a plurality of resilient spacers having a durometer between 90 A and 90 D, wherein each spacer has portions defining an axially extending rod receiving hole which opens radially outwardly, each spacer having a barb on each side of the rod receiving holes, the barbs being resilient to permit displacement of the barbs as the spacer is pressed over the rod to engage with the rod between the cantilevered legs of two screen bars, wherein the rod extends through the holes in the spacers, and wherein the spacers and cantilevered legs are clamped together, thereby joining and stiffening the cantilevered legs of the bars.

2. The apparatus of claim 1 wherein the rod is substantially square in cross section, and wherein the spacer rod receiving hole is approximately square.

3. A rack of screen bars for use in a bar screen, the rack comprising:

a plurality of screen bars arrayed in spaced parallel relation, each bar having at least two depending legs for mounting the bars to a bar screen apparatus, wherein a centrally supported section of each bar is defined between the two legs, and a cantilevered portion extends from the centrally supported portion, wherein the cantilevered portion has a depending cantilevered leg, the cantilevered leg having rod receiving portions;

a rod extending through the rod receiving portions of the cantilevered legs of said plurality of screen bars;

a plurality of resilient spacers, wherein each spacer has portions defining an axially extending rod receiving hole which opens radially outwardly, each spacer having a barb on each side of the rod receiving holes, the barbs being resilient to permit displacement of the barbs as the spacer is pressed over the rod to engage with the rod between the cantilevered legs of two screen bars, wherein the rod extends through the holes in the spacers, and wherein the spacers and cantilevered legs are clamped together, thereby joining and stiffening the cantilevered legs of the bars, wherein the rod receiving portions in the cantilevered legs define upwardly opening slots, such that the rod with spacers positioned thereon may be removably positioned in the rod receiving portions.

4. A resilient spacer for positioning between short depending legs of bars of a rack of bars, each bar having two depending legs which are mounted to oscillate on a drive frame, wherein the bar proper extends between the two depending legs and extends beyond the two depending legs, a section of each bar being cantilevered to one side of the portion of the bar between the two depending legs, the cantilevered sections of the support bars benefit from being joined together to control the spacing of the bars and to add rigidity to the rack of bars which comprise a portion of a bar screen deck, the cantilevered portions of the bars having said short depending legs, the resilient spacer comprising:

a resilient polyurethane body having an overall cylindrical hockey puck shape, the polyurethane body having, a durometer between 90 A and 90 D;

portions of the body which define a central aperture extending axially through the body, the central aperture being adapted to receive a rod therethrough to permit the clamping of the spacer between adjacent portions of bar screen bars;

portions of the body which define a pie shaped cut-away portion forming an inlet opening to the central aperture, the inlet opening being narrower than the central aperture; and portions of the body which define sides adjacent the inlet opening, the sides being deflectable to allow the spacer to be engaged on a rod by being depressed radially onto the rod, wherein the resilient body has a generally cylindrical exterior, and wherein the central aperture defines a substantially square opening, and wherein the body sides define two spaced barbs which are bendable when engaged by the rod to permit the spacer to be pressed into axial engagement on the rod.

5. A rack of screen bars for use in a bar screen, the rack comprising:

a plurality of screen bars arrayed in spaced parallel relation, each bar having at least two depending legs for mounting the bars to a bar screen apparatus, wherein a centrally supported section of each bar is defined between the two legs, and a cantilevered portion extends from the centrally supported portion, wherein the cantilevered portion has a depending cantilevered leg, the cantilevered leg having rod receiving portions;

a rod extending through the rod receiving portions of the cantilevered legs of said plurality of screen bars;

a plurality of resilient spacers each of which engages with the rod between the cantilevered legs of two screen bars, wherein the rod extends through the holes in the spacers, and wherein the spacers and cantilevered legs are clamped together, thereby joining and stiffening the cantilevered legs of the bars, and wherein the rod receiving portions in the cantilevered legs define upwardly opening slots, such that the rod with spacers positioned thereon may be removably positioned in the rod receiving portions.

* * * * *